United States Patent [19]

Geible

[11] 4,422,770

[45] Dec. 27, 1983

[54] PAINT STIRRER

[76] Inventor: Harry F. Geible, 6975 Wil-O-Paw Rd., Coloma, Mich. 49038

[21] Appl. No.: 340,688

[22] Filed: Jan. 20, 1982

[51] Int. Cl.[3] ..... B01F 7/32

[52] U.S. Cl. ..... 366/248; 366/251; 366/279; 366/331; 366/605

[58] Field of Search ..... 366/242, 244, 245, 247, 366/248, 249, 251, 279, 281, 282, 331, 342, 343, 605; 403/196, 197, 201

[56] References Cited

U.S. PATENT DOCUMENTS

| | | | |
|---|---|---|---|
| 569,428 | 9/1896 | Saxes | 366/605 X |
| 793,844 | 7/1905 | Libbman | 366/331 |
| 1,447,653 | 3/1923 | Fish | 366/605 X |
| 1,698,402 | 1/1929 | Harris | 366/605 X |
| 3,704,007 | 11/1972 | Kroeger | 366/248 |

*Primary Examiner*—Philip R. Coe
*Assistant Examiner*—Arthur D. Dahlberg
*Attorney, Agent, or Firm*—Flynn, Thiel, Boutell & Tanis

[57] ABSTRACT

An electric drill powered paint stirrer for stirring paint in a conventional paint marketing can of the kind normally closed for sale by a lid. A second lid is substitutable on the can for the marketing lid and has a central opening. A stirring rod assembly is releasably securable in the second lid. The assembly comprises a bushing element having a reduced diameter externally threaded and extending from a shoulder. The bushing has a central through bore. The second lid opening is of diameter to snugly receive the threaded bushing end therethrough but not the shoulder. The assembly further includes a stirring rod having an upstanding shank extending upward through the bushing. The rod has upper and lower radially widened portions closely flanking the upper and lower ends of the bushing for axially locating the shank in the bushing. The rod has a bottom portion depending from the shank and sized to lie close to the can peripheral wall and bottom for stirring paint in the marketing can. A nut is threadable on the threaded bushing end to clamp the second lid against the shoulder of the bushing.

5 Claims, 3 Drawing Figures

PAINT STIRRER

FIELD OF THE INVENTION

This invention relates to a paint stirrer of the kind to be powered by an electric drill.

BACKGROUND OF THE INVENTION

Small painting jobs, such as painting of a room in a residence by a homeowner or hired painter frequently leave part of a can of paint left over which one may desire to use at some later time, for example weeks or months later. Also, a can (quart or gallon) of paint is occasionally purchased and it is subsequently found that the painting job must be delayed for unanticipated reasons. In either instance, when later the marketing can is opened for use, the paint is not in condition for painting, but rather requires stirring to mix components which have become stratified, heavy components typically sinking to the bottom of the container in the heavy, thick sludgelike manner.

In the past it has been common for the homeowner or painter to stir the stratified paint in the can with a hand paddle, but this is a time consuming, wearying chore which often leaves the paint imperfectly mixed. Stirring devices, for example in the form of a multibladed propeller or the like have been marketed to be driven by a portable hand electric drill for stirring of paint, but such devices have not been entirely satisfactory. Often such devices are merely chucked in the electric drill and are guided entirely by hand within the paint container, without any form of cover interposed between the stirred paint and the person handling the drill. This may result in splashing of paint upon the user, requires some degree of effort and skill to hold and maneuver the drill while stirring, and often leaves portions of the paint and paint sludge in the container unstirred due to failure of the stirring device to be placed in some locations within the can.

Other prior stirring devices have employed supports for the stirring member. However, these have often overly complex and expensive and/or difficult to assemble or clean or operate.

Accordingly, the objects and purposes of this invention include provision of a paint stirrer, drivable by an electric drill, for stirring of paint in the marketing can or container in which it is sold, which protects the user against splashing, which stirs paint and paint sediment close to the walls and bottom of a paint marketing can, which is sized to fit closely a standard sized conventional paint marketing can, which is capable of being shipped flat and yet readily assembled by unskilled persons in a single assembly operation without tools or with only a common pair of pliers, which in inexpensive to manufacture and does not require complex manufacturing facilities, and which is easily disassembled for replacement of parts.

Other objects and purposes of this invention will be apparent to persons acquainted with apparatus of this kind upon reviewing the accompanying drawings and reading the following specification.

The objects and purposes of this invention are met by providing a stirrer for paint in a conventional paint marketing can of a kind normally closed for sale by a lid. The stirrer includes a second lid substitutable on the can for the marketing lid having a central opening. A stirring rod assembly is securable on the second lid. The assembly includes a bushing element having a reduced diameter externally threaded end rising from a shoulder. The bushing includes a central through bore. The second lid opening is of diameter to snugly receive the threaded bushing upper end therethrough but not the shoulder. The stirring rod has an upstanding shank extending upward through the bushing. The rod has radially widened upper and lower portions closely flanking the upper and lower ends of the bushing for axially locating the shank in the bushing. The rod has a bottom portion depending from the shank and sized to lie close to the can peripheral wall and bottom for stirring paint in the can. A nut is threadable on the threaded bushing end to clamp the lid against the shoulder of the bushing.

DETAILED DESCRIPTION

Figure 1:
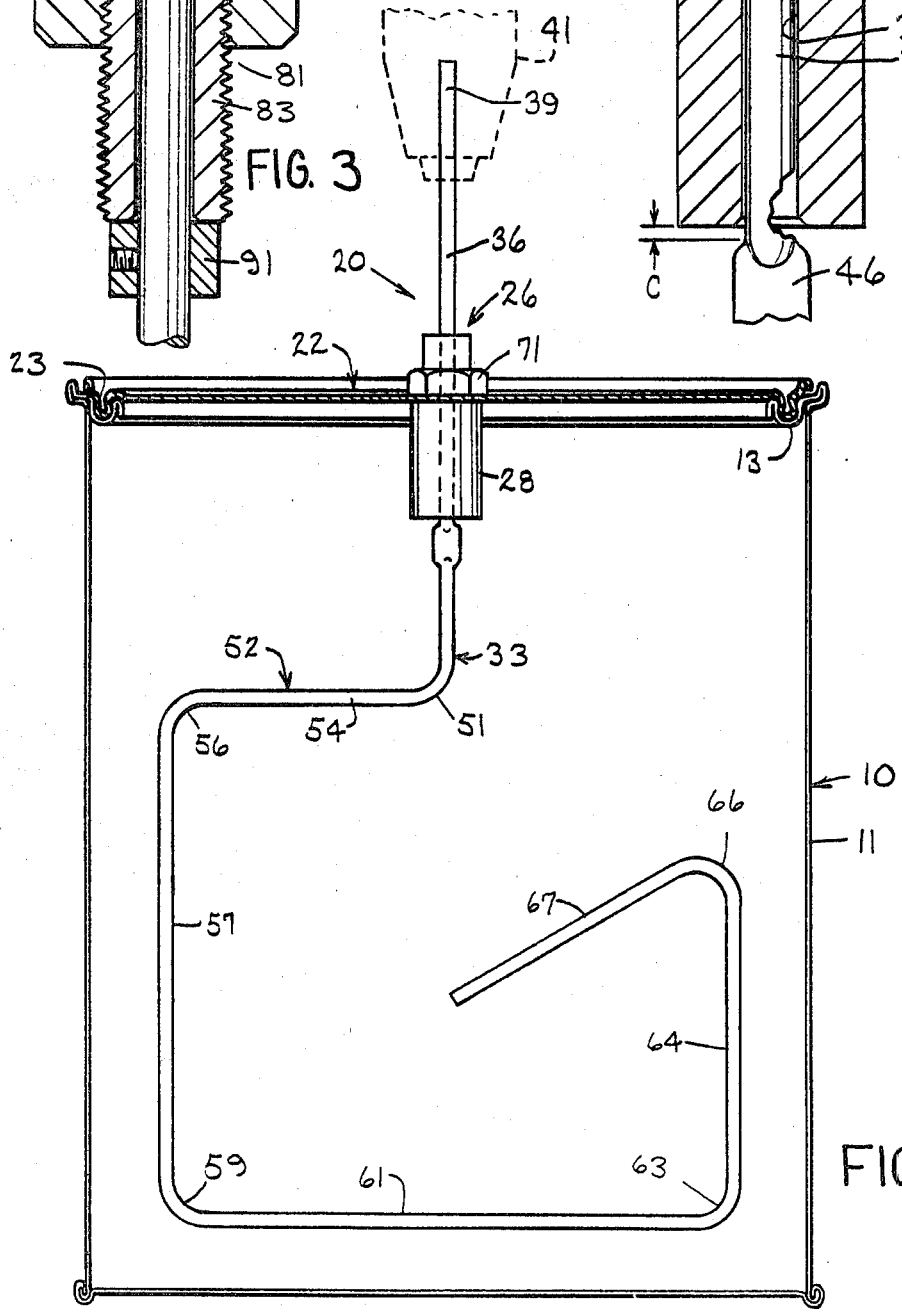
FIG. 1 is a central cross-sectional view of a paint stirrer embodying the invention and installed in a position of use in a paint marketing can.

FIG. 1 discloses in central cross section a paint can 10 of the kind in which paint, such as exterior or interior house paint, is conventionally marketed. The can 10 includes a cylindrical peripheral wall 11 and a bottom wall 12. The top of the can is open and is bounded by a radially inward extending flange 13 formed in the top of the peripheral wall 11. The flange 13 has a conventional, substantially U-cross section configuration for cooperation with a complementary formed flange on the periphery of a conventional marketing cover, not shown, wherein forcing of a lid downward upon the top of the can 10 forces the lid flange into sealed, tight gripping relation with the flange 13 of the can in a well known manner for effecting sealed closure of the top of the can. Such lid may be removed by prying with a screwdriver or the like when access to the paint in the can is required, in a conventional manner.

Figure 2:
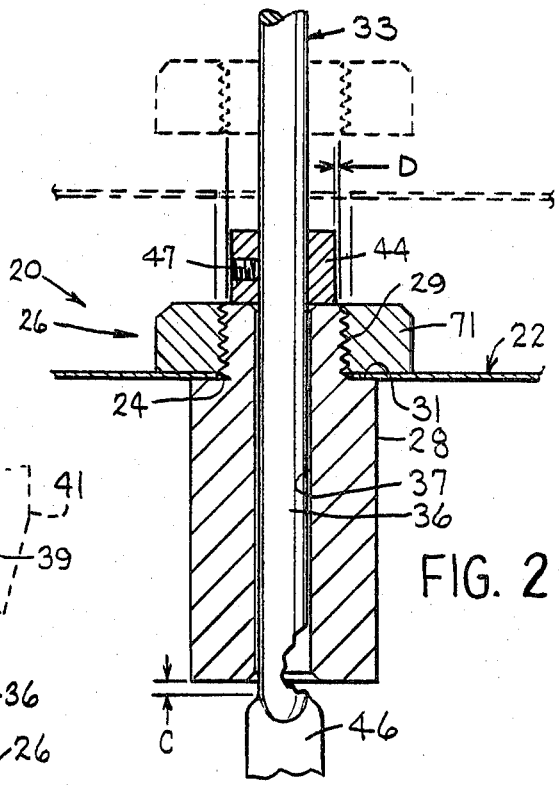
FIG. 2 is an enlarged, partially broken fragment of FIG. 1 in the area of the bushing and second lid.

Turning now to the apparatus embodying the invention, FIG. 1 discloses Applicant's paint stirrer 20. The stirrer 20 includes a further lid 22 directly substitutable for the mentioned conventional marketing lid. Preferably, the second lid 22 is itself a lid of the conventional paint marketing type, having a peripheral flange 23 of the type described as being cooperative to close and seal with the can lid 13. As provided in the present invention however, the second lid 22 is provided with a central opening 24 (FIG. 2).

The stirrer 20 further includes a stirring rod assembly 26 which includes a bushing 28. The bushing 28 is preferably of carbon steel, which is both inexpensive and long-wearing. The bushing has a reduced diameter externally threaded upper end 29 (FIG. 2) rising from an upward facing horizontal shoulder 31. The length of the bushing 28 preferably exceeds its diameter.

The stirring rod assembly further includes a stirring rod generally indicated at 33. The stirring rod 33 preferably is a conventional 0.188 inch diameter steel rod formed to the configuration hereafter described. The stirring rod 33 includes an upstanding shank 36 extending upward through the central bore 37 of the bushing 28 in snug but relatively rotative relation therewith. The upper end 39 of the shank 37 is spaced above the bushing 28 for rotative driving engagement by a conventional electric drill chuck indicated in broken lines at 41, such as the chuck of a conventional ¼ inch or ⅜ inch electric hand drill of common household type.

The shank 37 has radially widened portions 44 and 46 fixed thereon and closely flanking the bushing 28 at the upper and lower ends, respectively, thereof for vertically locating the stirring rod with respect the bushing. The radially widened portions 44 and 46 are engageable with the ends of the bushing in thrust bearing relation thereon. In the preferred embodiment shown in FIGS. 1 and 2, the upper widened portion 44 is a cylindrical collar snugly but axially slidably received over the upper end of the shank 36 and fixed thereto by a conventional set screw, here of common Allen type at 47. The outside diameter of the collar 44 is less than the inside diameter of the central hole 24 of the lid 22, permitting assembly of the lid onto the stirring assembly 26 by reception of the upper end of shank 36, the threaded upper end 29 of the bushing 28 and the collar 44, fixed in place on the shank, upward through the hole 24 in the lid 22 until the lid comes to rest on the shoulder 31 of the bushing.

The radially widened portion 46 below bushing 28, as shown in FIG. 2, comprises a crimped or otherwise deformed, relatively short, length of the rod of width greater than the diameter of the bushing bore 37. In the FIG. 2 embodiment, the height of the crimped portion 46 was about ⅜ inch with a minimum material thickness of about ⅛ inch (about two-thirds the normal diameter of the rod stock of the shank). To prevent any tendency to bind, an axial clearance, indicated at C in FIG. 2, is established between the ends of the bushing 28 and the widened portions 44 and 46, and this clearance is normally at the lower end of the bushing due to gravitational forces causing the rod to be vertically supported by the bushing. Chamfering the ends of the bore 37 facilitates insertion of the shank 36 into the bushing.

The rod 33 extends downward in a continuation of the shank to a point about two-thirds the height of the can 10 and then is bent to form the bottom, or paint stirring, portion 52 of the stirring rod, at a first bend 51 which is preferably of 90°. The bottom portion 52 of the rod includes a first segment 54 which extends substantially radially toward the peripheral wall 11 of the can then through a second bend 56, preferably of about 90°, and then downward in a second segment 57, in parallel with the peripheral wall of the can, to a point near the bottom 12 of the can. The rod extends from the second segment 57 through a third bend 59 of approximately 90° into a third segment 61. The rod at the end (rightward end in FIG. 1) of the third segment 61 is bent upward through a fourth bend 63 into a fourth segment 65 which extends upward close to and along the opposite peripheral wall 11 of the paint can for about two-thirds the height of the second segment 57 and through a fifth bend 66, of about 120°, to connect with the fifth and last segment 67 of the rod. The fifth, or terminating, segment 67 thus angles downward at about 30° from the horizontal and terminates at a point substantially on the axis of the shank 36 and at a height about one-third of the way up the second segment 57 from the bottom segment 61.

The overall width of the stirring rod from segment 57 to segment 64 is slightly less (for example ½ inch less) than the inside diameter of the upper end of the paint can, for easy insertion of the stirring rod into the paint can, but the upstanding segments 57 and 64 are located close (about ½ inch) from the adjacent peripheral wall 11 so that, upon rotation, the upstanding segments 57 and 64 will, either by direct mechanical contact or by producing local turbulence, tend to strip from the peripheral wall 11 paint solids which may in time tend to collect on the peripheral wall. The horizontal bottom segment 61 is normally close spaced (about ½ inch) from the bottom wall 12 of the can for similar action in stripping away therefrom of collected paint solids.

The radially extending first rod segment 54 is located to assist in stirring when the can is about two-thirds or more full of paint but is not needed to stir the smaller paint mass when the paint level in the can is below about two-thirds full. The re-entrant and downwardly angled fifth segment is provided to insure adequate mixing of paint materials within the relatively large cylindrical space bounded, during rotation, by the rod segments 54, 57, 61 and 64, so that the paint in the central portion of the can receives adequate agitation. The stirring rod, from the upper end 39 of the shank to the free end of the fifth segment 67, lies entirely in a single plane, to permit packaging of the paint stirrer 20 in a relatively thin flat package for marketing or storage.

As seen in FIG. 1, the bottom portion 52 of the rod is not symmetrical with respect to the axis of the shank. It is clear that the part of the bottom portion 52 to the right of the shank axis differs in shape and somewhat in length (and hence weight) from the part of the bottom portion 52 to the left of the shank axis. Accordingly, the bottom portion 52 is intentionally thus made somewhat unbalanced both in a static and dynamic sense, such that the rotating bottom portion 52 will tend to vibrate gently in the paint while rotated by the drill chuck 41, to hasten mixing of the paint by assisting the stirring action somewhat with a modest degree of vibration. On the other hand the imbalance and consequent vibration are intentionally limited (the weight of rod to the right and left of the shank axis differing by only about 10 percent or less in the preferred embodiment shown) to limit wear by the shank on the bore of the bushing 28 and to avoid any tendency of the lid 22 to loosen its grip on the top of the can during stirring.

The stirring rod assembly 26 further includes a conventional nut 71 (FIG. 2) threadable onto the threaded upper end of the bushing to grip the central portion of the lid 22 between the shoulder 31 and nut 71. It will be noted that the minimum internal diameter of the nut 71 is greater than the maximum outside diameter of the collar 44 (by clearance indicated at D in FIG. 2). In this way, the bushing 28 and collar 44 can be pre-assembled, in the position shown, onto the shank 36 of the steering rod at the point of manufacture, so as to properly axially locate the bushing on the shank of the steering rod, wherein the set assembly thus provided can be shipped disassembled from the lid 22 in a flat relatively thin package where, subsequent to use, it can be compactly stored.

To use the stirrer, same is assembled at the point of use by inserting the upper end of the shank 36, the collar 44, and the threaded upper end of the bushing 28 through the central opening 24 in the lid 22 (to occupy the position shown in FIG. 2) and then passing the nut 71 loosely over the upper end of the shank 36 and collar 44 and threadedly tightening it on the threaded upper end 29 of the bushing 28 to fix the bushing coaxially to the lid 22. The upper end 39 of the shank can then be chucked in an electric drill chuck 41 and the lower end 52 of the stirring rod can be lowered into the paint in the can 10 until the lid 22 comes to rest in closed sealing position on the flange 13 of the can. The lid 22 need not be forcibly seated on the can, as would a conventional lid for sealing and preventing of evaporation from the can, but rather the lid 22 need merely be lightly but firmly seated and, if desired, held gently in place by the user with one hand while the other operates the drill.

After stirring is completed, the stirring assembly is easily cleaned, usually by rotation in a corresponding can partially filled with an appropriate paint thinner liquid. Alternately, the stirrer assembly 20 may be disassembled, by removal of nut 71 and lid 22 from the stirring rod assembly 26 in a reversal of the above-described assembly operation, for cleaning and compact storage.

It will be noted from the foregoing that assembly of the lid 22 to the stirring rod assembly 26 requires only the threading and unthreading of the nut 71 which requires no special tools but only a common wrench or a pair of pliers at most. In a preferred stirring rod the overall lengths of the segments 57, 61 and 64 were about $4\frac{3}{4}$ inch, $5\frac{1}{4}$ inch and $3\frac{1}{4}$ inch, respectively, the height of the free end of the fifth segment 67 above the opposed surface of the third segment 61 was about $1\frac{3}{4}$ inch and the first segment 54 was offset downwardly about $1\frac{1}{2}$ inch from the top of the widened portion 46.

Figure 3:
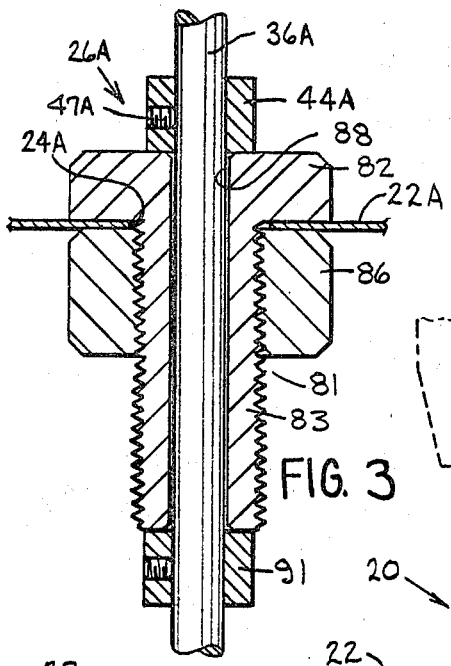
FIG. 3 is a view similar to FIG. 2 and showing a modification.

Whereas the preferred embodiment above described with respect to FIGS. 1 and 2 requires some machining operations to form the crimp 46 and the bushing 28, some of the advantages of the preferred FIGS. 1, 2 embodiment can be enjoyed with the embodiment of FIG. 3 which is readily manufacturable by the average homeowner from strictly commercially available parts. In FIG. 3 parts corresponding to those of FIGS. 1 and 2 carry the same reference numerals with the suffix A added. The bushing 28 and nut 71 in the FIGS. 1, 2 embodiment are replaced in FIG. 3 with a conventional bolt 81 having its head 82 resting atop the lid 22A and its threaded shaft 83 extending down through the central opening 34A in the lid and secured to the lid by a conventional nut 86 threaded on the bolt shaft 83 and bearing against the underside of the lid 22A. The bolt 82 is modified by provision therein of a central longitudinal through bore 88, which is readily provided with a conventional drill, for example an electric drill of household type.

The shank 36A of the stirring rod thus is guided snugly but rotatably in the through bore 88 of the bolt 83, in correspondence to guidance of the shank 36 in the bore of the FIG. 2 bushing 28.

However, unlike in the FIG. 2 embodiment, disassembly of the FIG. 3 shank assembly 26A from the lid 22A requires not only loosening of the nut 86 but also removal of the collar 44A, which requires a tool for loosening of the set screw 47A.

Where it is desired to avoid the need to crimp or otherwise deform the shank (as at 46 in FIG. 2) the radially widened portion can instead be provided by means of a set screw secured collar, as at 91 in FIG. 3.

It may be noted that it has been found desirable to have the shank supporting bushing 28 (FIG. 2) extend down into the can, below the lid, to its major extent, to reduce paint splash up through the bushing in the space between the bushing and shank of the stirring rod. Also, it is desirable that the bushing extend to a lesser extent above the top of the lid 22, to minimize the leverage of sideward leaning of the drill on the lid 22 and any tendency of the lid to thereby tilt upward off the top of the can when in use by a careless user. Further, when the apparatus is assembled for use, no exposed threads appear above the lid 22, avoiding any tendency to snag fingers or clothing on the portion of the apparatus exposed above the lid during use.

Although particular embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An electric drill powered paint stirrer for stirring paint in a conventional paint marketing can of the kind normally closed for sale by a full closing marketing lid, comprising in combination:

a second full closing lid, similar to and substitutable on said can for said marketing lid but having a central opening;

a bushing element having one reduced diameter, externally threaded end extending from a shoulder, the bushing element having a central through bore, said central opening of the second lid being of diameter to snugly receive said threaded end therethrough but not said shoulder, said bushing element being elongate with length substantially exceeding diameter, substantially more than half of the length of said bushing element extending downward beneath the second lid and into the can, with only a minor portion of the bushing extending above the lid, a nut threadable on said threaded end of said bushing element to clamp said second lid against the said shoulder, a stirring rod having an upstanding shank extending upward through said bushing element and shaped for chucking in the chuck of a conventional electric drill, said rod having upper and lower widened portions closely flanking the upper and lower ends of the bushing element for axially locating said shank in said bushing element, said rod having a bottom portion depending from said shank and sized to lie close to the can peripheral wall and bottom for stirring paint in the can, said bottom portion of said rod below said lower widened portion extending down in a continuation of the shank, said continuation being of length small compared to the can diameter, then in an upper radial segment extends radially to near one side of the can, then in a depending segment extends down to near the can bottom, then in a lower diametral segment extends diametrally across the central portion of the can and then in an upstanding segment extends upward near the opposite side of the can to a point spaced below the level of the upper radial segment, and then in a free end segment extends angularly downward toward the center of the can, the upstanding segment extending up for approximately two-thirds the height of the depending segment, the free end segment angling downward therefrom at about 30° from the horizontal and terminating at a point substantially on the axis of the shank and at a height approximately one-third of the way up the depending segment from the lower diametral segment, so that the angled free end segment is spaced vertically a substantial distance from both the upper and lower segments of said rod and radially a substantial distance from the depending segment.

2. The apparatus of claim 1, in which said bushing element is a bushing having a relatively short threaded end, said threaded end being upwardly extending through said opening in said lid to an extent corresponding to the height of the nut, the nut being applied on top of the lid with the major length of said bushing, which extends below said lid, being of diameter greater than said opening in said lid to form said shoulder engaging the lower side of the lid, said upper radially widened portion having a maximum diameter less than the internal diameter of said nut to receive said nut loosely thereover and to install said bushing on said lid without need to remove said upper radially widened portion from said shank.

3. The apparatus of claim 1, in which said bushing element is a conventional bolt provided with a longitudinal through bore, the bolt having a head riding atop the lid, with the threaded end of the bolt extending down through the central opening in the lid, the nut on said threaded end engaging the bottom of said lid, said upper radially widened portion being a collar set screwed to the shank for removal from said shank to permit removal of said lid from said bushing element.

4. The apparatus of claim 1, in which said upper widened portion on said shank is a collar fixed to but removable from the upper end of said shank for separating said rod from said bushing for purposes of replacement, said stirring rod being a rod of constant diameter throughout its length except for a flattened and widened part forming said lower radially widened part.

5. The apparatus of claim 1 in which the upper radial segment of the rod is spaced above the bottom of the can by about two-thirds the height of the can, the overall lengths of the depending, lower diametral and upstanding segments being about $4\frac{3}{4}$ inch, $5\frac{1}{4}$ inch and $3\frac{1}{4}$ inch respectively, the height of the angled free end segment above the lower diametral segment being about $1\frac{3}{4}$ inch and the upper radial segment being set down about $1\frac{1}{2}$ inch from the top of the lower widened portion.

* * * * *